US008956700B2

(12) United States Patent
Taxacher et al.

(10) Patent No.: US 8,956,700 B2
(45) Date of Patent: Feb. 17, 2015

(54) METHOD FOR ADHERING A COATING TO A SUBSTRATE STRUCTURE

(75) Inventors: Glenn Curtis Taxacher, Simpsonville, SC (US); Andres Garcia Crespo, Greenville, SC (US); Herbert Chidsey Roberts, III, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/276,713

(22) Filed: Oct. 19, 2011

(65) Prior Publication Data

US 2013/0101806 A1 Apr. 25, 2013

(51) Int. Cl.

| | |
|---|---|
| ***C23C 4/02*** | (2006.01) |
| ***F01D 5/14*** | (2006.01) |
| ***F01D 5/28*** | (2006.01) |
| *B05D 3/10* | (2006.01) |

(52) U.S. Cl.

CPC . *C23C 4/02* (2013.01); *B05D 3/102* (2013.01); *F01D 5/14* (2013.01); *F01D 5/288* (2013.01); *F05D 2230/90* (2013.01)

USPC ..... 427/309; 427/307; 427/327; 427/330

(58) Field of Classification Search

USPC ..... 427/307, 327, 328

See application file for complete search history.

(56) References Cited

U.S. PATENT DOCUMENTS

| | | | |
|---|---|---|---|
| 3,574,924 | A | 4/1971 | Dibble |
| 3,627,444 | A | 12/1971 | Lentz |
| 3,638,464 | A | 2/1972 | Winter et al. |
| 3,646,471 | A | 2/1972 | DeMent |
| 3,732,031 | A | 5/1973 | Bowling et al. |
| 3,778,241 | A | 12/1973 | Winter et al. |
| 3,857,750 | A | 12/1974 | Winter et al. |
| 3,944,782 | A | 3/1976 | Metcalfe et al. |
| 3,988,913 | A | 11/1976 | Metcalfe et al. |
| 4,042,162 | A | 8/1977 | Meginnis et al. |
| 4,097,294 | A | 6/1978 | Rice et al. |

(Continued)

FOREIGN PATENT DOCUMENTS

| | | | |
|---|---|---|---|
| EP | 0448339 | A1 | 9/1991 |
| EP | 0256790 | B1 | 8/1992 |

(Continued)

OTHER PUBLICATIONS

Search Report and Written Opinion from EP Application No. 12179583.5 dated Jan. 30, 2013.

*Primary Examiner* — David Turocy
(74) *Attorney, Agent, or Firm* — Cantor Colburn LLP

(57) ABSTRACT

A method for adhering a coating to a substrate structure comprises selecting a substrate structure having an outer surface oriented substantially parallel to a direction of radial stress, modifying the outer surface to provide a textured region having steps to adhere a coating thereto, and applying a coating to extend over at least a portion of the textured region, wherein the steps are oriented substantially perpendicular to the direction of radial stress to resist deformation of the coating relative to the substrate structure. A rotating component comprises a substrate structure having an outer surface oriented substantially parallel to a direction of radial stress. The outer surface defines a textured region having steps to adhere a coating thereto, and a coating extends over at least a portion of the textured region. The steps are oriented substantially perpendicular to the direction of radial stress to resist creep.

16 Claims, 8 Drawing Sheets

(56) References Cited

U.S. PATENT DOCUMENTS 4,188,811 A 2/1980 Brimm
4,208,170 A 6/1980 Tucker et al.
4,335,997 A 6/1982 Ewing et al.
4,411,730 A 10/1983 Fishter et al.
4,589,176 A 5/1986 Rosman et al.
4,605,452 A 8/1986 Gemma et al.
4,659,288 A 4/1987 Clark et al.
4,802,823 A 2/1989 Decko et al.
4,889,355 A 12/1989 Trimble
4,932,147 A 6/1990 David
4,986,949 A 1/1991 Trimble
5,060,842 A 10/1991 Qureshi et al.
5,063,662 A 11/1991 Porter et al.
5,083,371 A 1/1992 Leibfried et al.
5,158,733 A 10/1992 Trimble
5,160,822 A 11/1992 Aleshin
5,176,499 A 1/1993 Damlis et al.
5,193,314 A 3/1993 Wormley et al.
5,273,708 A 12/1993 Freeman
5,356,264 A 10/1994 Watson et al.
5,419,971 A * 5/1995 Skelly et al. ..... 428/612
5,465,780 A 11/1995 Muntner et al.
5,503,532 A 4/1996 Schilling
5,537,814 A 7/1996 Nastuk et al.
5,545,003 A 8/1996 O'Connor et al.
5,584,663 A 12/1996 Schell et al.
5,622,638 A 4/1997 Schell et al.
5,641,014 A 6/1997 O'Connor et al.
5,643,474 A 7/1997 Sangeeta
5,649,806 A 7/1997 Scricca et al.
5,810,552 A 9/1998 Frasier
5,916,638 A 6/1999 Zajchowski et al.
5,924,483 A 7/1999 Frasier
5,932,940 A 8/1999 Epstein et al.
5,998,755 A 12/1999 Zajchowski et al.
6,049,978 A 4/2000 Arnold
6,071,363 A 6/2000 O'Connor et al.
6,077,002 A 6/2000 Lowe
6,139,303 A 10/2000 Reed et al.
6,146,692 A 11/2000 Sangeeta et al.
6,177,038 B1 1/2001 Reed et al.
6,199,746 B1 3/2001 Dupree et al.
6,206,642 B1 3/2001 Matheny et al.
6,224,361 B1 5/2001 Reed et al.
6,244,327 B1 6/2001 Frasier
6,248,399 B1 6/2001 Hehmann
6,251,315 B1 6/2001 Reed et al.
6,255,000 B1 7/2001 O'Connor et al.
6,287,080 B1 9/2001 Evans et al.
6,299,935 B1 10/2001 Park et al.
6,302,649 B1 10/2001 Mukira et al.
6,329,633 B1 12/2001 Lamm et al.
6,331,217 B1 12/2001 Burke et al.
6,354,799 B1 3/2002 Mukira et al.
6,392,313 B1 5/2002 Epstein et al.
6,394,750 B1 5/2002 Hiskes
6,409,853 B1 6/2002 Thamboo et al.
6,413,582 B1 7/2002 Park et al.
6,413,650 B1 7/2002 Dupree et al.
6,415,486 B1 7/2002 Prevey, III
6,454,536 B1 9/2002 Evans et al.
6,468,367 B1 10/2002 Mukira et al.
6,490,899 B2 12/2002 Berthelet et al.
6,511,630 B1 1/2003 Cartier et al.
6,520,838 B1 2/2003 Shaw
6,544,460 B2 4/2003 Reed et al.
6,565,680 B1 5/2003 Jackson et al.
6,592,948 B1 7/2003 Fusaro, Jr. et al.
6,607,355 B2 8/2003 Cunha et al.
6,622,570 B1 9/2003 Prevey, III
6,696,176 B2 2/2004 Allen et al.
6,709,230 B2 3/2004 Morrison et al.
6,753,634 B2 6/2004 Rehder
6,846,574 B2 * 1/2005 Subramanian ..... 428/595
6,884,507 B2 4/2005 Lin et al.
6,913,186 B2 7/2005 Vyas
6,923,623 B2 8/2005 Cleveland et al.
6,941,973 B2 9/2005 Hehmann
6,952,095 B1 10/2005 Goldfine et al.
7,033,448 B2 4/2006 Groh et al.
7,043,819 B1 5/2006 Arnold
7,094,444 B2 8/2006 Rigney et al.
7,163,136 B2 1/2007 Hempstead
7,207,869 B2 4/2007 James
7,230,421 B2 6/2007 Goldfine et al.
7,247,000 B2 7/2007 Cahoon et al.
7,255,531 B2 8/2007 Ingistov
7,293,326 B2 11/2007 Hawkins et al.
7,441,331 B2 10/2008 Hudson et al.
7,487,641 B2 2/2009 Frechette et al.
7,497,663 B2 3/2009 McRae et al.
7,589,526 B2 9/2009 Goldfine et al.
7,618,240 B2 11/2009 Saltman et al.
7,625,184 B2 12/2009 Jay et al.
7,632,072 B2 12/2009 Sheffield
7,637,010 B2 12/2009 Burgess et al.
7,648,334 B2 1/2010 Hurst et al.
7,648,340 B2 1/2010 Sadler et al.
7,686,571 B1 3/2010 Matheny
7,709,057 B2 5/2010 Fusaro, Jr. et al.
7,722,329 B2 5/2010 Clarke
7,736,704 B2 6/2010 Chandra et al.
7,740,948 B1 6/2010 Alvin
7,741,576 B2 6/2010 Trimmer et al.
7,762,534 B2 7/2010 Ouellette et al.
7,763,356 B2 7/2010 Berczik et al.
7,771,160 B2 8/2010 Shi et al.
7,785,098 B1 8/2010 Appleby et al.
7,841,834 B1 * 11/2010 Ryznic ..... 416/224
7,858,205 B2 12/2010 Allen et al.
7,862,262 B2 1/2011 Sasu et al.
7,910,225 B2 3/2011 Taylor
7,927,714 B2 4/2011 Carter et al.
7,980,052 B1 7/2011 Paulino
7,981,520 B2 7/2011 Bewlay et al.
7,993,704 B2 8/2011 Raybould et al.
2001/0008323 A1 7/2001 Reed et al.
2002/0076488 A1 6/2002 Park et al.
2002/0174528 A1 11/2002 Prevey, III
2003/0027495 A1 2/2003 Shaw
2003/0034379 A1 2/2003 Jackson et al.
2003/0041801 A1 3/2003 Hehmann
2003/0068222 A1 4/2003 Cunha et al.
2003/0069321 A1 4/2003 Lin et al.
2003/0088980 A1 5/2003 Arnold
2003/0134040 A1 7/2003 Fusaro, Jr. et al.
2003/0170489 A1 9/2003 Allen et al.
2003/0223861 A1 12/2003 Morrison et al.
2004/0009297 A1 1/2004 Fusaro, Jr. et al.
2004/0018299 A1 1/2004 Arnold et al.
2004/0031140 A1 2/2004 Arnold et al.
2004/0035914 A1 2/2004 Hempstead
2004/0046003 A1 3/2004 Vyas
2004/0198852 A1 10/2004 Lin et al.
2005/0031449 A1 2/2005 Cleveland et al.
2005/0056354 A1 3/2005 Groh et al.
2005/0064146 A1 3/2005 Hollis et al.
2005/0152805 A1 7/2005 Arnold et al.
2005/0186079 A1 8/2005 Ingistov
2005/0221057 A1 * 10/2005 Hollis et al. ..... 428/172
2005/0241147 A1 11/2005 Arnold et al.
2005/0248339 A1 11/2005 Goldfine et al.
2005/0268463 A1 12/2005 Ouellette et al.
2006/0010871 A1 1/2006 Frechette et al.
2006/0021184 A1 2/2006 Hawkins et al.
2006/0029723 A1 2/2006 Rigney et al.
2006/0039788 A1 2/2006 Arnold et al.
2006/0041448 A1 2/2006 Patterson et al.
2006/0042084 A1 3/2006 Hudson et al.
2006/0082366 A1 4/2006 Goldfine et al.
2006/0189265 A1 8/2006 James
2006/0200963 A1 9/2006 Lutz
2006/0248718 A1 11/2006 Szela et al.
2006/0260125 A1 11/2006 Arnold et al.

(56) References Cited

U.S. PATENT DOCUMENTS

| | | | | |
|---|---|---|---|---|
| 2007/0124933 | A1 | 6/2007 | Burgess et al. | |
| 2007/0154316 | A1 | 7/2007 | Clarke | |
| 2007/0154318 | A1 | 7/2007 | Saltman et al. | |
| 2007/0183895 | A1 | 8/2007 | Sheffield | |
| 2007/0183896 | A1 | 8/2007 | Jay et al. | |
| 2007/0183897 | A1 | 8/2007 | Sadler et al. | |
| 2007/0183898 | A1 | 8/2007 | Hurst et al. | |
| 2007/0224401 | A1 | 9/2007 | Telander | |
| 2007/0236214 | A1 | 10/2007 | Goldfine et al. | |
| 2008/0011810 | A1 | 1/2008 | Burford | |
| 2008/0028607 | A1 | 2/2008 | Lamphere et al. | |
| 2008/0101959 | A1 | 5/2008 | McRae et al. | |
| 2008/0127450 | A1 | 6/2008 | Hawkins et al. | |
| 2008/0206000 | A1 | 8/2008 | Sasu et al. | |
| 2008/0223099 | A1 | 9/2008 | David | |
| 2008/0247635 | A1 | 10/2008 | Davis et al. | |
| 2008/0247636 | A1 | 10/2008 | Davis et al. | |
| 2008/0277384 | A1 | 11/2008 | Trimmer et al. | |
| 2008/0298975 | A1 | 12/2008 | James et al. | |
| 2009/0142221 | A1 | 6/2009 | Strangman | |
| 2009/0315540 | A1 | 12/2009 | Goldfine et al. | |
| 2009/0324401 | A1 * | 12/2009 | Calla | 415/200 |
| 2010/0012004 | A1 | 1/2010 | Telander | |
| 2010/0104433 | A1 | 4/2010 | Shi et al. | |
| 2010/0119871 | A1 | 5/2010 | Feng et al. | |
| 2010/0172760 | A1 | 7/2010 | Ammann | |
| 2010/0175218 | A1 | 7/2010 | Hawkins et al. | |
| 2010/0285269 | A1 | 11/2010 | Telander | |

FOREIGN PATENT DOCUMENTS

| | | | |
|---|---|---|---|
| EP | 0520714 | A1 | 12/1992 |
| EP | 0431019 | B1 | 6/1994 |
| EP | 0475882 | B1 | 3/1995 |
| EP | 0927773 | A2 | 7/1999 |
| EP | 1002615 | A2 | 5/2000 |
| EP | 1065296 | A1 | 1/2001 |
| EP | 1091013 | A1 | 4/2001 |
| EP | 1091021 | A1 | 4/2001 |
| EP | 1225324 | A2 | 7/2002 |
| EP | 0750957 | B1 | 3/2003 |
| EP | 1302628 | A2 | 4/2003 |
| EP | 0925844 | B1 | 7/2003 |
| EP | 1367223 | A2 | 12/2003 |
| EP | 1002619 | B1 | 7/2004 |
| EP | 1447208 | A2 | 8/2004 |
| EP | 1049562 | B1 | 2/2005 |
| EP | 1505255 | A2 | 2/2005 |
| EP | 1010776 | B1 | 4/2005 |
| EP | 1533396 | A2 | 5/2005 |
| EP | 0920575 | B1 | 6/2005 |
| EP | 1090711 | B1 | 8/2005 |
| EP | 1143106 | B1 | 8/2005 |
| EP | 1342803 | B1 | 8/2005 |
| EP | 1514632 | B1 | 2/2006 |
| EP | 0992310 | B1 | 5/2006 |
| EP | 1090710 | B1 | 5/2006 |
| EP | 1261455 | B1 | 8/2006 |
| EP | 1236534 | B1 | 9/2006 |
| EP | 1002617 | B1 | 10/2006 |
| EP | 1840239 | A1 | 10/2007 |
| EP | 1854903 | A1 * | 11/2007 |
| EP | 1890010 | A2 | 2/2008 |
| EP | 1002616 | B1 | 5/2008 |
| EP | 1074331 | B1 | 6/2008 |
| EP | 1721697 | B1 | 8/2008 |
| EP | 1002618 | B1 | 10/2008 |
| EP | 1714741 | B1 | 10/2008 |
| EP | 1629938 | B1 | 3/2009 |
| EP | 1705338 | B1 | 5/2009 |
| EP | 1792680 | B1 | 10/2009 |
| EP | 1510279 | B1 | 2/2010 |
| EP | 1743731 | B1 | 6/2010 |
| EP | 2204544 | A2 | 7/2010 |
| EP | 2022587 | B1 | 10/2010 |
| EP | 2275645 | A2 | 1/2011 |
| GB | 1378009 | A | 12/1974 |
| GB | 2272453 | A * | 5/1994 |
| WO | WO89/04789 | A1 | 6/1989 |
| WO | WO90/02479 | A2 | 3/1990 |
| WO | WO91/12111 | A1 | 8/1991 |
| WO | WO98/02643 | A1 | 1/1998 |
| WO | WO99/21680 | A2 | 5/1999 |
| WO | WO00/17490 | A2 | 3/2000 |
| WO | WO01/22076 | A1 | 3/2001 |
| WO | WO01/64397 | A2 | 9/2001 |
| WO | WO01/64398 | A2 | 9/2001 |
| WO | WO2005/061854 | A1 | 7/2005 |
| WO | WO2005/075894 | A1 | 8/2005 |
| WO | WO2006/015309 | A2 | 2/2006 |
| WO | WO2007/085912 | A2 | 8/2007 |
| WO | WO2007/093851 | A2 | 8/2007 |
| WO | WO2007/125382 | A2 | 11/2007 |
| WO | WO2007/141596 | A2 | 12/2007 |
| WO | WO2008/035135 | A2 | 3/2008 |
| WO | WO2008/090394 | A2 | 7/2008 |
| WO | WO2010/036801 | A2 | 4/2010 |

* cited by examiner

METHOD FOR ADHERING A COATING TO A SUBSTRATE STRUCTURE

FEDERAL RESEARCH STATEMENT

This invention was made with Government support under Contract No. DE-FC26-05NT42643, awarded by the US Department of Energy (DOE). The Government has certain rights in this invention.

BACKGROUND OF THE INVENTION

The subject matter disclosed herein relates to systems and methods for adhering coatings to substrate structures and more particularly to a method for reducing inelastic deformation of coatings applied to rotating components.

In rotating machines, such as turbine engines, components often include a coating to achieve a desirable performance, durability and/or life attribute of the components. For example, coatings may be configured to resist oxidation, erosion, heat transfer, contamination, and/or other processes. Such components typically comprise a substrate structure configured to satisfy a first set of design objectives and a coating that is bonded to an outer surface of the substrate structure, with the coating being configured to satisfy a second set of design objectives. The design objectives for a substrate structure may address mass limitations, structural requirements, and aerodynamic shape considerations while the design objectives for a coating may address different considerations such as adhesion to, and protection of, the substrate structure. Thus, the substrate structure typically, though not exclusively, comprises a different material than that of the coating. As a result, a rate of thermal expansion for the substrate structure may differ from a rate of thermal expansion for the coating, causing stresses at the bonds between the substrate structure and the coating.

In rotating machines, such as turbine engines, rotating machinery may be subjected to large radial accelerations, causing sustained high forces within their subject components. In addition, some components, such as turbine blades, may also be subjected to high temperatures. As a result, bonds between the substrate structure and the coating may be challenged. In some cases, the stresses applied to coated components can cause viscous or inelastic deformations in the coatings relative to the substrate structures (i.e., creep), with such deformations typically occurring in the direction of the loads. In rotating components, the direction of the loads is typically the radial direction.

Therefore, those skilled in the art seek new systems and methods for reducing inelastic deformation of coatings on rotating components.

BRIEF DESCRIPTION OF THE INVENTION

According to one aspect of the invention, a method for adhering a coating to a substrate structure comprises selecting a substrate structure having an outer surface oriented substantially approximately parallel to a direction of radial stress, modifying the outer surface to provide a textured region having steps to adhere a coating thereto, and applying a coating to extend over at least a portion of the textured region and to adhere to the outer surface, wherein the steps are oriented substantially perpendicular to the direction of radial stress so as to resist deformation of the coating relative to the substrate structure.

According to another aspect of the invention, a rotating component comprises a substrate structure having an outer surface oriented substantially approximately parallel to a direction of radial stress. The outer surface defines a textured region having steps to adhere a coating thereto, and a coating extends over at least a portion of the textured region and adheres to the outer surface. The steps are oriented substantially perpendicular to the direction of radial stress so as to resist deformation of the coating relative to the substrate structure.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
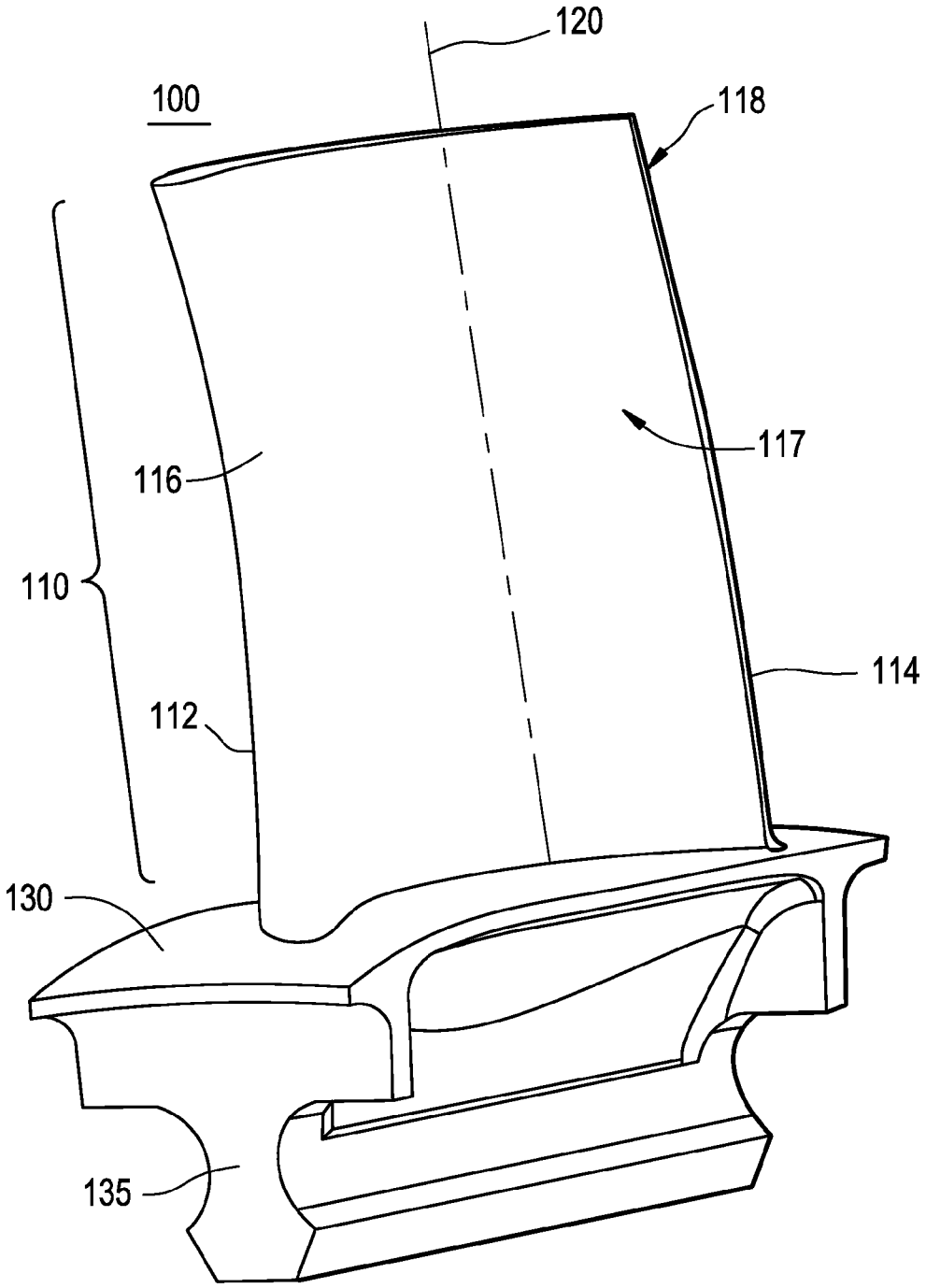
FIG. 1 is a drawing of an exemplary substrate structure ready to be modified so as to include steps in accordance with the invention.

FIG. 1 shows an exemplary substrate structure 100 configured to operate as a turbine blade in a gas turbine engine. Accordingly, substrate structure 100 includes an airfoil section 110 oriented along a radial axis 120 and coupled to a blade root 135 configured with a dovetail shape for retention by a turbine disk. In accordance with aerodynamic considerations, airfoil section 110 includes a thickened leading edge 112 and a relatively thin trailing edge 114. Between leading edge 112 and trailing edge 114, airfoil section 110 includes an outer surface 116 having a concave pressure side 117 and a convex suction side 118. Substrate structure 100 also includes an inner shroud 130 positioned between airfoil section 110 and blade root 135. Shroud 130 is oriented approximately perpendicular to radial axis 120 (i.e., in a circumferential orientation). In an exemplary embodiment, substrate structure 100 may comprise any material suitable for the environment and duty cycle in which substrate structure will perform. For example, substrate structure 100 may comprise steel, nickel, titanium, aluminum, chromium, molybdenum, and composite materials including those with carbon and/or silicon carbide fibers.

Figure 2:
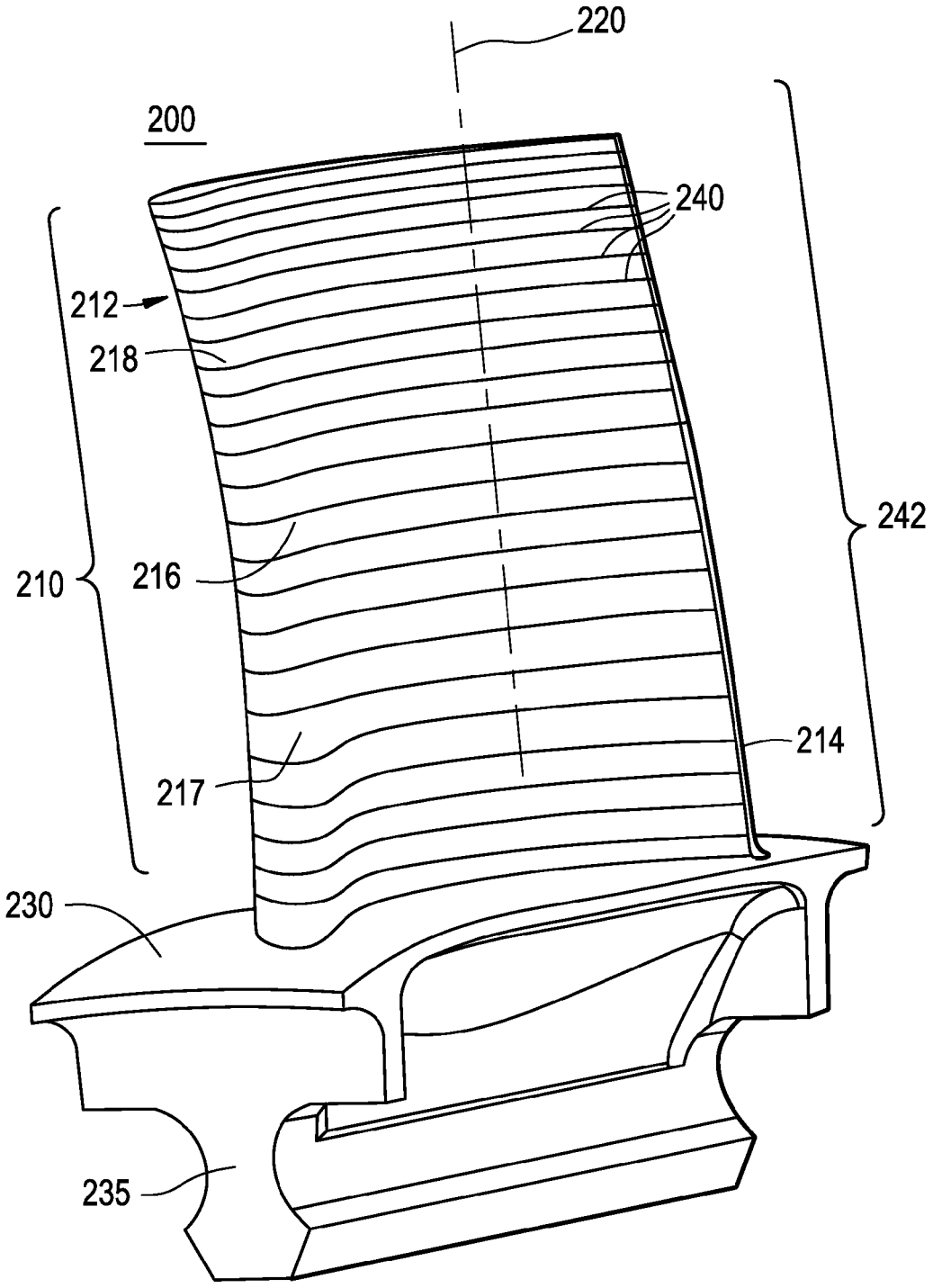
FIG. 2 a drawing of an exemplary substrate structure that has been modified so as to include steps in accordance with the invention.

As shown in FIG. 2, similarly to the substrate structure 100 depicted in FIG. 1, an exemplary substrate structure 200 includes an airfoil section 210 oriented along a radial axis 220 and coupled to a blade root 235 configured with a dovetail shape for retention by a turbine disk. Substrate structure 200 also includes an inner shroud 230 positioned between airfoil section 210 and blade root 235, and shroud 230 is oriented approximately perpendicular to radial axis 220 (i.e., in a circumferential orientation). Notably, an outer surface 216 of airfoil section 210 defines a series of steps 240 which form a textured region 242 covering, in this embodiment, the entirety of airfoil section 210 on both its concave pressure side 217 and its convex suction side 218. Steps 240 are oriented substantially approximately parallel to one another and substantially perpendicular to the radial axis 220 of the substrate structure. In this embodiment, steps 240 extend from the leading edge 212 to the trailing edge 214 in an orientation that is also substantially approximately parallel to a direction of flow of a working fluid of the gas turbine engine in which the substrate structure 200 is to operate. Accordingly, in embodiments where an exterior surface of an applied coating reveals the steps of the textured region, the contours will be oriented along the streamlines of the flow, inducing less disruption than if the contours were oriented at an oblique angle to the streamlines.

It should be noted that, as used herein, the orientation of the radial axis 220 is defined by the orientation of the maximum stresses imposed on substrate structure 200 in operation, as installed in a turbine engine and as retained by a rotating turbine disk. Accordingly, as the substrate structure 200 rotates, the radial stresses imposed on the substrate structure 200 are, by definition, oriented along the radial axis 220. Since the outer surface 216 of substrate structure 200 is oriented substantially approximately parallel to a direction of radial stress when viewed as a whole, a bond between the outer surface 216 and a coating applied over the outer surface is generally and primarily subjected to a shear stress. Thus, in the absence of steps 240, the ability of the bond to resist creep is primarily dependent upon the strength of the bond in shear.

In an exemplary embodiment of the invention, however, since steps 240 are oriented substantially perpendicular to the radial axis 220, and thus the direction of the radial stresses (i.e., the direction of maximum loading), the steps 240 provide a mechanism for assisting a coating to resist creep relative to the steps 240 and the textured region 242 they define on the outer surface 216 of substrate structure 200. To accomplish this, the steps 240 (including their shapes, configurations, depths, orientations, and spacing) are configured to provide a series of buttresses (i.e., bearing surfaces) against which the coating may bear. As a result, the coating may resist creep, at least locally adjacent to the bearing surfaces, through its strength in compression, thereby enabling the coating to better resist creep.

In an exemplary embodiment, the steps 240 may be shallow, square-edged, and/or recursive, and due to the substantially approximately parallel orientation of steps 240, the textured region may bear a ruled appearance. The dimensions of the steps 240 are typically sufficiently great in magnitude that the textured region provides a stepped surface texture rather than merely a stepped grain structure, and the steps 240 thus provide a means for resisting viscous or inelastic deformation (i.e., creep) of any coating (such as a protective coating) that may be applied over or otherwise adhered to textured region 242. Accordingly, The stepped surface of the textured region 242 acts as a self-bonding substrate to which a coating may be adhered.

To form the steps 240, the outer surface 216 may be machined before application of a coating over the textured region 242 of the substrate structure 200. Alternatively other methods known in the art may be used including mechanical grinding, laser cutting, chemical etching, burnishing, embossing, stamping, cold forming, casting, molding, or forging. In an exemplary embodiment, tooling used to form the steps 240, such as a mold for casting or a mask for chemical etching or a tool for machining or embossing or stamping, is shaped to be complementary to the contours of the steps 240. In another exemplary embodiment, steps 240 are formed through a series of machining and/or laser etching passes. Therefore, another exemplary tool is shaped to be complementary to a single step.

After a coating is applied over the textured region 242, the coating may be configured to form a relatively uniform and smooth outer surface that is substantially free from steps or other discontinuities. Alternatively, an exterior surface of an applied coating may be configured so as to reveal the steps of the textured region, and the contours may be oriented to be aligned substantially with streamlines of the flow of the working fluid passing over the component. Exemplary coatings may be ceramic or metallic (e.g., containing nickel) and may be selected and/or configured so as to resist oxidation, erosion, heat transfer, and/or contamination that might otherwise impact the performance and/or life of the substrate structure, while bonding effectively to substrate structure 200.

Figure 3:
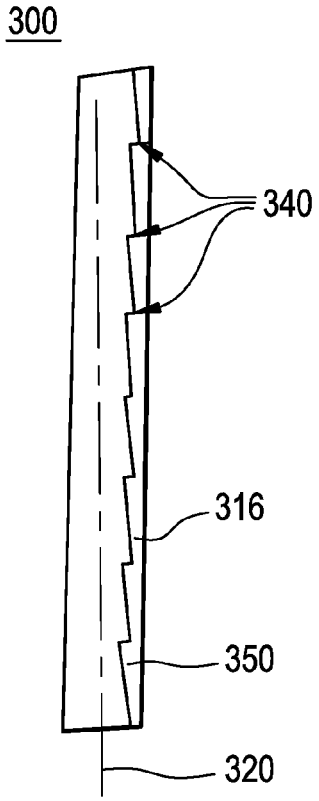
FIG. 3 is a drawing of an exemplary substrate structure that has been modified so as to include steps in accordance with the invention.

As shown in FIG. 3, a substrate structure 300 is disposed along a radial axis 320 such that an outer surface 316 of substrate structure 300 is oriented substantially approximately parallel to radial axis 320 and includes a series of steps 340 that are oriented substantially approximately parallel to one another and substantially perpendicular to the radial axis 320. A coating 350 extends over the steps 340 that form the textured region of the outer surface 316, and the coating 350 is bonded or adheres to the outer surface 316. In this embodiment, the coating is configured to form a relatively uniform and smooth outer surface that is substantially free from steps or other discontinuities. It should be appreciated, however, that alternative embodiments are possible wherein an applied coating is configured to reveal the steps of the textured region. In some embodiments, the contours may also be oriented along the streamlines of the flow, inducing less disruption than if the contours were oriented at an oblique angle to the streamlines. These streamlines may or may not be oriented in parallel to the steps 340.

Figure 4:
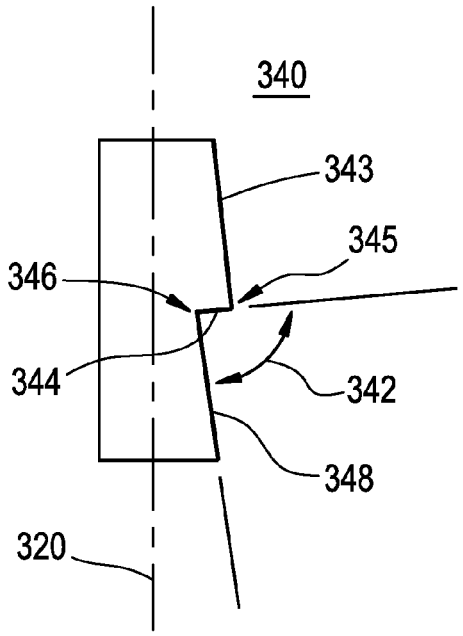
FIG. 4 is an enlarged drawing of a step as shown in FIG. 3.

As shown in FIG. 4, which depicts an enlarged section of the substrate structure 300 of FIG. 3, each step 340 includes a step nose 345 and a step knee 346. Step nose 345 is a sharp corner defined by the intersection of shear surface 343 and bearing surface 344. In this embodiment, bearing surface 344 is approximately (e.g., within 15 degrees of being) perpendicular to radial axis 320, and shear surface 343 is approximately (e.g., within 15 degrees of being) parallel to radial axis 320. Accordingly, shear surface 343 and bearing surface 344 meet at step nose 345 where they form an approximate (e.g., between about 70 degrees and 110 degrees) 90 degree angle relative to one another. At step knee 346, which is a sharp inside corner, bearing surface 344 meets another shear surface 348 to form the step knee 346, which has a knee angle 342 of approximately about 90 degrees.

In operation with a coating applied over steps 340, and with a radial load applied to the coating, the coating may bear against the bearing surface 344 so as to resist creep. Therefore, the coating can rely upon its internal strength in compression while pressing against bearing surface 344 (rather than merely the shear strength of its bond with a surface such as the shear surfaces 343, 348) to resist creep relative to substrate structure 300. In an exemplary embodiment, the dimensions of the bearing wall are selected so as to achieve a desirable balance among design considerations including a rate of heat transfer through the coating, uniformity of the outer surface of the coating, mechanical integrity of the substrate structure and the coating, resistance to oxidation, resistance to erosion, resistance to contamination, and/or adhesion of the coating to the substrate structure, all at operational levels. The coating may be deposited at a thickness characteristic of a process selected from spraying, sintering, flame spraying, vapor deposition, sputtering, and electro-less coating.

Figure 5:
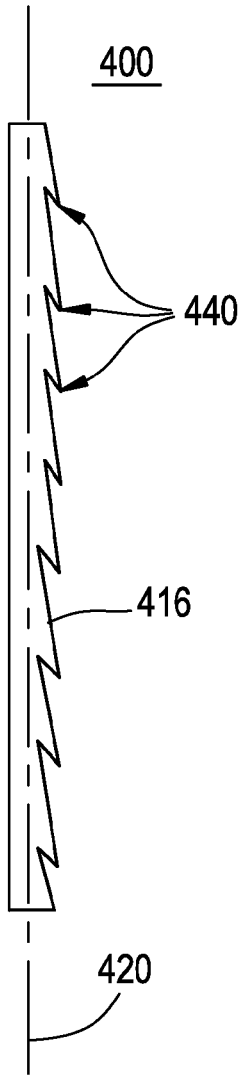
FIG. 5 is a drawing of an exemplary substrate structure that has been modified so as to include steps in accordance with the invention.
Figure 6:
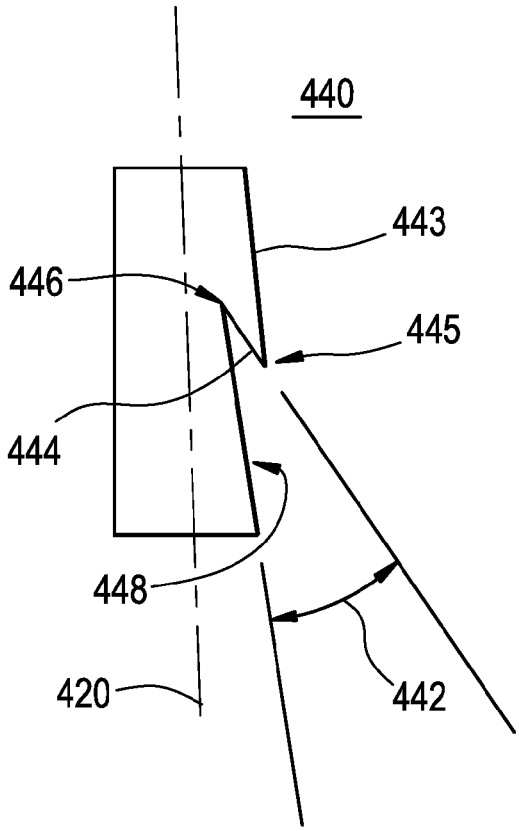
FIG. 6 is an enlarged drawing of a step as shown in FIG. 5.

As shown in FIG. 5, a substrate structure 400 is disposed along a radial axis 420 such that an outer surface 416 is oriented substantially approximately parallel to radial axis 420 and includes a series of steps 440 that are oriented substantially approximately parallel to one another and substantially perpendicular to the radial axis 420. As shown in FIG. 6, which depicts an enlarged section of the substrate structure 400 of FIG. 5, each step 440 includes a step nose 445 and a step knee 446. Step nose 445 is a sharp corner defined by the intersection of shear surface 443 and bearing surface 444. In this embodiment, bearing surface 444 is oriented at a relatively steep angle (e.g., approximately 45 degrees from perpendicular) relative to radial axis 420. Shear surface 443 is approximately (e.g., within 15 degrees of being) parallel to radial axis 420. Accordingly, shear surface 443 and bearing surface 444 meet at step nose 445 where they form an approximate 45 degree angle relative to one another.

At step knee 446, which is a sharp inside corner, bearing surface 444 meets another shear surface 448 to form the step knee 446, which has a knee angle 442 of approximately about 45 degrees. In operation with a coating applied over steps 440, and with a radial load applied to the coating, the coating may bear against the bearing surface 444 so be compressed into step knee 446 and to resist creep. Therefore, the coating can rely upon its internal strength in compression while pressing against bearing surface 444 (rather than merely the shear strength of its bond with a surface such as the shear surfaces 443, 448) to resist creep relative to substrate structure 400.

Figure 7:
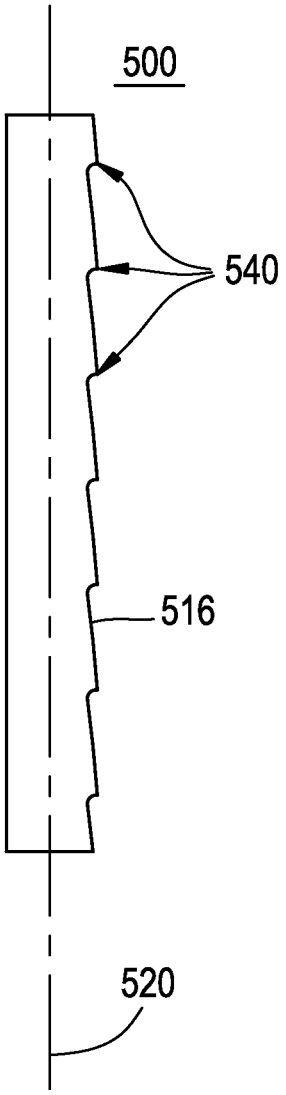
FIG. 7 is a drawing of an exemplary substrate structure that has been modified so as to include steps in accordance with the invention.
Figure 8:
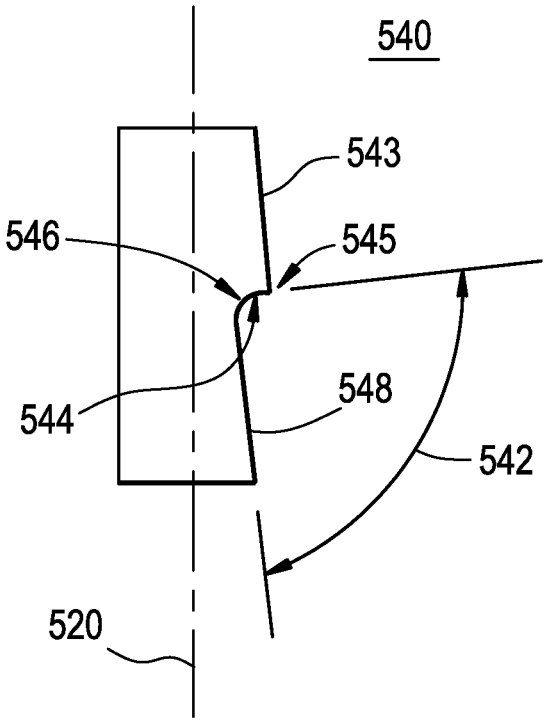
FIG. 8 is an enlarged drawing of a step as shown in FIG. 7.

As shown in FIG. 7, a substrate structure 500 is disposed along a radial axis 520 such that an outer surface 516 is oriented substantially approximately parallel to radial axis 520 and includes a series of steps 540 that are oriented substantially approximately parallel to one another and substantially perpendicular to the radial axis 520. As shown in FIG. 8, which depicts an enlarged section of the substrate structure 500 of FIG. 7, each step 540 includes a step nose 545 and a step knee 546. Step nose 545 is a sharp corner defined by the intersection of shear surface 543 and bearing surface 544. In this embodiment, bearing surface 544 is approximately (e.g., within 15 degrees of being) perpendicular to radial axis 520, and shear surface 543 is approximately (e.g., within 15 degrees of being) parallel to radial axis 520. Accordingly, shear surface 543 and bearing surface 544 meet at step nose 545 where they form an approximate 90 degree angle relative to one another.

At step knee 546, which is a continuous inside corner, bearing surface 544 is gradually contoured to meet a similarly gradually contoured shear surface 548 to form the continuous step knee 546, which has a knee angle 542 of approximately about 90 degrees. In operation with a coating applied over steps 540, and with a radial load applied to the coating, the coating may bear against the bearing surface 544 so as to resist creep while reducing the potential for stress concentrations and discontinuities associated with a more sharply defined inside corner. Therefore, the coating can rely upon its internal strength in compression while pressing against bearing surface 544 (rather than merely the shear strength of its bond with a surface such as the shear surfaces 543, 548) to resist creep relative to substrate structure 500.

Figure 9:
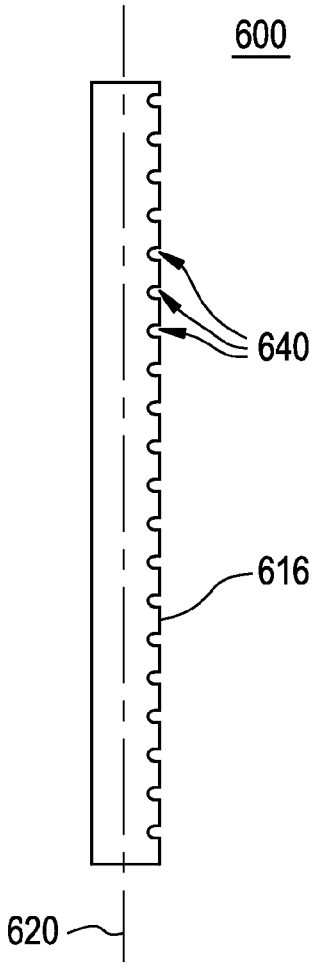
FIG. 9 is a drawing of an exemplary substrate structure that has been modified so as to include steps in accordance with the invention.
Figure 10:
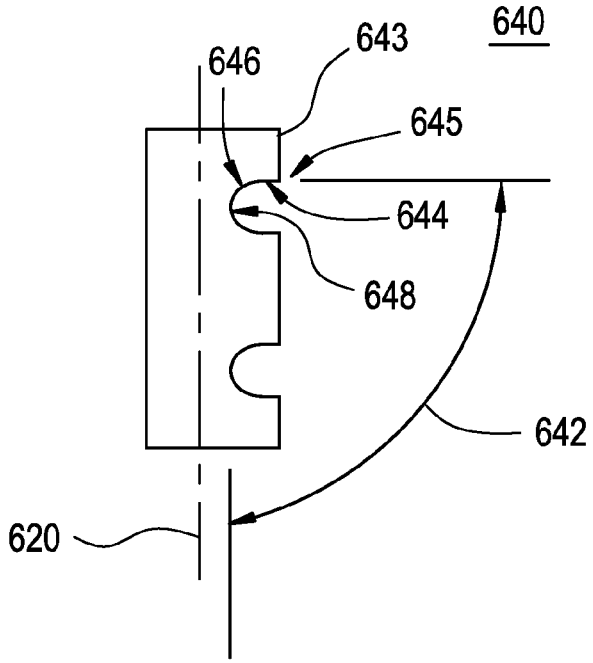
FIG. 10 is an enlarged drawing of a step as shown in FIG. 9.

As shown in FIG. 9, a substrate structure 600 is disposed along a radial axis 620 such that an outer surface 616 is oriented substantially approximately parallel to radial axis 620 and includes a series of steps 640 that are oriented substantially approximately parallel to one another and substantially perpendicular to the radial axis 620. As shown in FIG. 10, which depicts an enlarged section of the substrate structure 600 of FIG. 9, each step 640 includes a step nose 645 and a step knee 646. Step nose 645 is a sharp corner defined by the intersection of shear surface 643 and bearing surface 644. In this embodiment, bearing surface 644 is approximately (e.g., within 15 degrees of being) perpendicular to radial axis 620, and shear surface 643 is approximately (e.g., within 15 degrees of being) parallel to radial axis 620. Accordingly, shear surface 643 and bearing surface 644 meet at step nose 645 where they form an approximate 90 degree angle relative to one another.

At step knee 646, which, as shown in FIG. 10, is a continuous inside corner, bearing surface 644 meets another shear surface 648 to form the step knee 646, which has a knee angle 642 of approximately about 90 degrees. It should be appreciated, however, that the profile of a step 640 may also be configured such that bearing surface 644 is substantially perpendicular to shear surface 643 while step knee 646 defines a discontinuous, sharp inside corner of approximately about 90 degrees, and a profile of shear surface 648 is substantially straight, oriented substantially parallel to shear surface 643. In operation with a coating applied over steps 640, and with a radial load applied to the coating, the coating may bear against the bearing surface 644 so as to resist creep. Therefore, the coating can rely upon its internal strength in compression while pressing against bearing surface 644 (rather than merely the shear strength of its bond with a surface such as the shear surfaces 643, 648) to resist creep relative to substrate structure 600.

Figure 11:
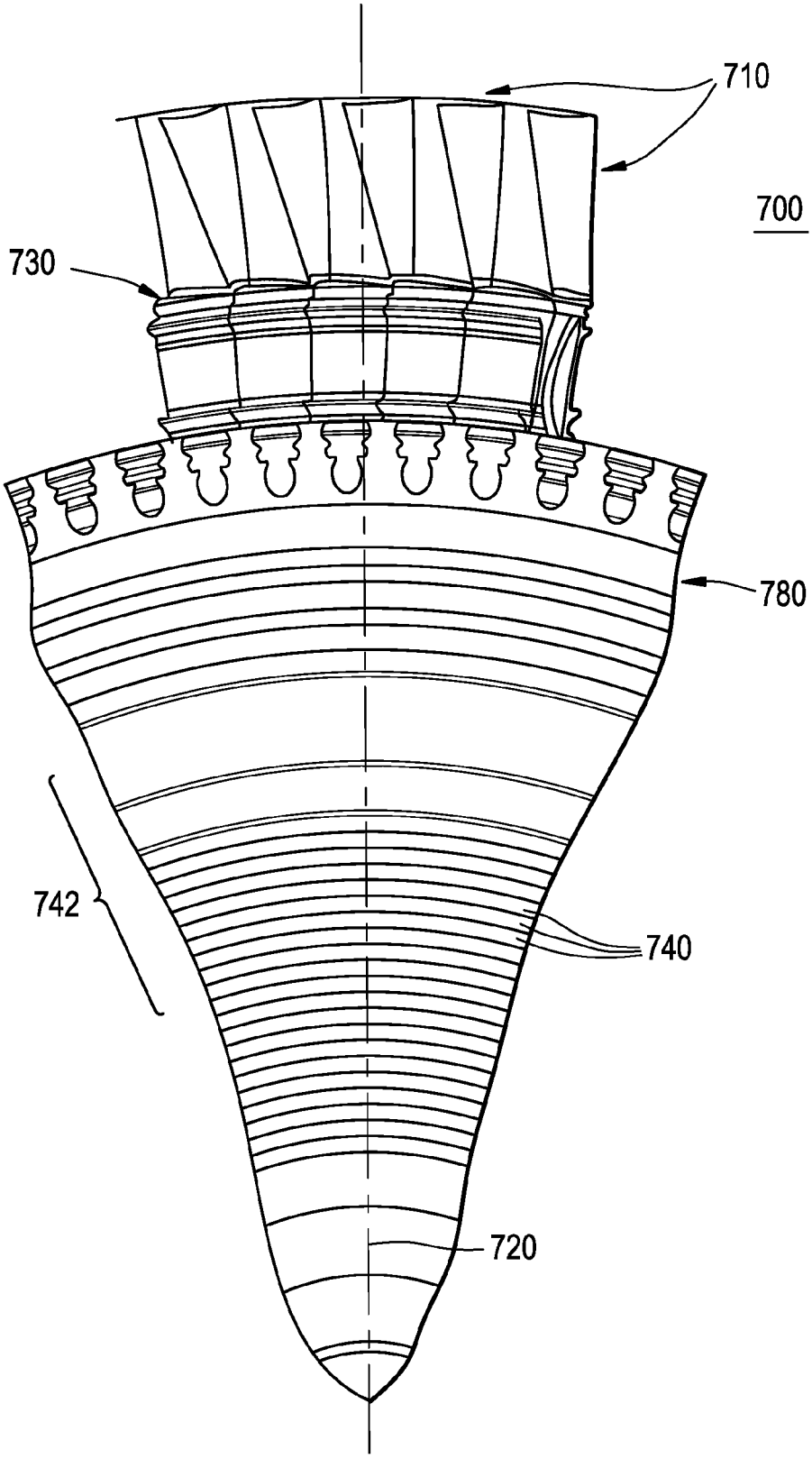
FIG. 11 is a drawing of an exemplary substrate structure that has been modified so as to include steps in accordance with the invention.

As shown in FIG. 11, a turbine assembly 700 comprises a substrate structure 780 in the form of a turbine disk configured for retaining a plurality of turbine blades 710. An outer surface of substrate structure 780 defines a series of steps 740 which form a textured region 742 covering, in this embodiment, a substantial portion of substrate structure 780. Steps 740 are oriented substantially approximately parallel to one another and substantially perpendicular to a radial axis 720 of the substrate structure 780. Put another way, steps 740 are oriented substantially along a circumferential direction of the substrate structure 780 so as to resist creep relative to substrate structure 780 due to stresses oriented in the radial direction.

Figure 12:
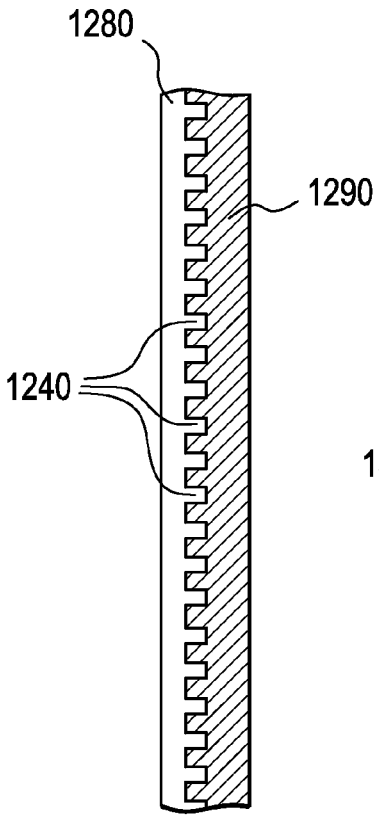
FIG. 12 is a drawing of an exemplary coated substrate structure that has been modified so as to include steps and a coating in accordance with the invention.
Figure 13:
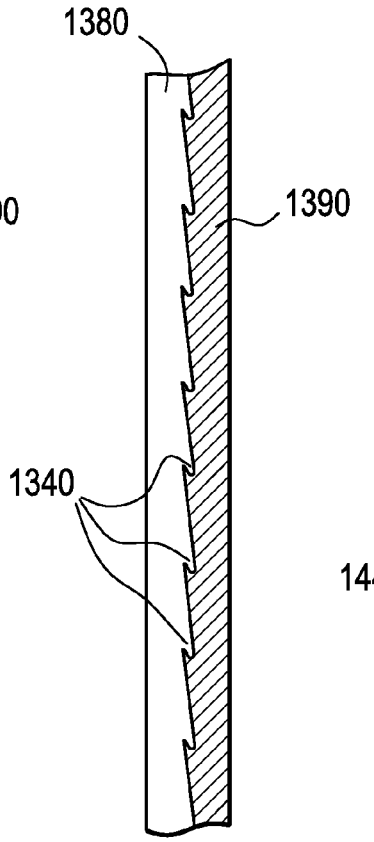
FIG. 13 is a drawing of an exemplary coated substrate structure that has been modified so as to include steps and a coating in accordance with the invention.
Figure 14:
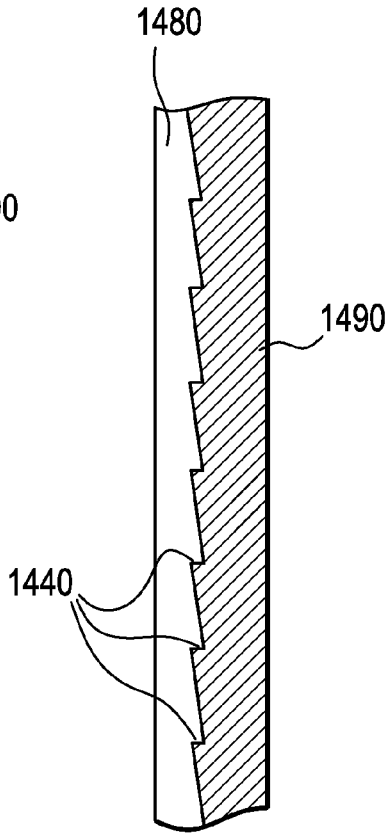
FIG. 14 is a drawing of an exemplary coated substrate structure that has been modified so as to include steps and a coating in accordance with the invention.

FIG. 12 shows a cutaway of an exemplary substrate structure 1280 that has been modified so as to include steps 1240 and has had a coating 1290 applied so as to cover the steps 1240 and to produce a desirable exterior surface profile and finish. As one skilled in the art will appreciate, coating 1290 and substrate structure 1280 are selected and configured so as to meet specific design criteria and mission requirements of their particular application. For example, where a substrate structure 1280 is to be installed in a gas turbine engine, substrate structure 1280 is selected and configured so as to satisfy structural and/or other requirements that are associated with that installation, while coating 1290 is selected and configured so as to provide qualities such as protective qualities to the coated substrate. These qualities may qualities such as, but not limited to, thermal resistance or conductivity, oxidation resistance, erosion resistance, friction resistance or enhancement, surface tension, material strength, hardness, and permeation resistance (i.e., hermetic sealing). Similarly, FIG. 13 shows a cutaway drawing of another exemplary substrate structure 1380 that has been modified so as to include steps 1340 and has had a coating 1390 applied so as to cover the steps 1340 and produce a desirable external surface profile and finish. FIG. 14 shows another cutaway drawing of another exemplary substrate structure 1480 that has been modified so as to include steps 1440 and that has had a coating 1490 applied so as to cover the steps 1440.

Accordingly, the invention provides systems and methods for reducing inelastic deformation of coatings on rotating components that operate at sufficiently high rotations and temperatures such that creep is a concern. Such components include, without limitation, turbine airfoils and disks. Thus, the invention provides a system and method for reducing creep on coatings, such as thermal barrier coatings, and/or oxidation resistant coatings applied to turbine blades/buckets in aviation and energy applications where gas path temperatures often exceed 2000 degrees F. Accordingly, the invention can enable substantial improvements in the durability and service life of rotating turbo machine components. The invention may also enable rotating components to operate at reduced levels of cooling flow, resulting in improvements in cycle efficiencies and power production.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method for adhering a coating to a substrate structure, the method comprising:

selecting a substrate structure having an outer surface oriented substantially parallel to a direction of radial stress;

modifying an entirety of the outer surface to provide a textured region having steps to adhere a coating thereto; and applying a coating to extend over at least a portion of the textured region and to adhere to the outer surface;

wherein the modifying of the outer surface comprises forming each of the steps to define a nose at which first ends of shear and bearing surfaces meet to define a first angle and a knee at which second ends of the shear and bearing surfaces meet to define a second angle oppositely oriented relative to the first angle, the shear surface of each step being substantially straight along an entirety thereof and parallel with each of the respective shear surfaces of the other steps, the bearing surface of each step being curved along an entirety thereof and parallel with each of the respective bearing surfaces of the other steps such that corresponding portions of each of the steps are oriented in parallel with one another and each of the steps are oriented approximately perpendicular to the direction of radial stress so as to resist deformation of the coating relative to the substrate structure.

2. A method as described in claim 1, further comprising orienting the steps approximately along a circumferential direction of the substrate structure.

3. A method as described in claim 1, further comprising forming each of the steps so as to define the bearing surface against which a coating may bear so as to resist creep through compression of the coating.

4. A method as described in claim 3, further comprising orienting the bearing surface within approximately 15 degrees relative to perpendicularity with respect to the direction of radial stress.

5. A method as described in claim 3, further comprising orienting the bearing surface so as to form an angle that is less than about 90 degrees relative to the direction of radial stress.

6. A method as described in claim 3, further comprising orienting the bearing surface so as to form an angle that is between about 90 degrees and about 45 degrees relative to the direction of radial stress.

7. A method as described in claim 3, further comprising orienting the bearing surface approximately about 45 degrees relative to the direction of radial stress.

8. A method as described in claim 1, further comprising forming each of the steps so as to define a discontinuous knee including a secondary shear surface recessed from the shear surface.

9. A method as described in claim 1;

wherein said applying a coating is performed such that said coating adheres directly to the outer surface;

further comprising depositing the coating at a thickness characteristic of a process selected from spraying, sintering, flame spraying, vapor deposition, sputtering, and electro-less coating.

10. A method as described in claim 1, wherein the substrate structure is a turbine airfoil.

11. A method as described in claim 1, wherein the substrate structure is a turbine disk.

12. A method as described in claim 1, wherein the modifying comprises machining the outer surface.

13. A method as described in claim 1, wherein the modifying comprises one or more of grinding, laser cutting, chemical etching, burnishing, embossing, stamping, cold forming, casting, molding or forging the outer surface.

14. A method for adhering a coating to a substrate structure, the method comprising:

selecting a substrate structure having an outer surface oriented substantially parallel to a direction of radial stress;

modifying an entirety of the outer surface to provide a textured region having steps to adhere a coating thereto, the modifying comprising forming each of the steps to define a nose at which first ends of shear and bearing surfaces meet to define a first angle and a knee at which second ends of the shear and bearing surfaces meet to define a second angle, which is oppositely oriented relative to the first angle; and applying a coating to extend over at least a portion of the textured region and to adhere to the outer surface, wherein the steps are oriented approximately perpendicular to the direction of radial stress so as to resist deformation of the coating relative to the substrate structure and the first and second angles are acute and of substantially equal magnitude such that the nose overhangs the knee of each step relative to a direction defined perpendicularly with respect to the direction of radial stress.

15. The method according to claim 14, wherein the steps are parallel and each of the first and second angles of each of the steps are acute and of substantially equal magnitude.

16. A method for adhering a coating to a substrate structure, the method comprising:

selecting a substrate structure having an outer surface oriented substantially parallel to a direction of radial stress;

modifying an entirety of the outer surface to provide a textured region having grooves to adhere a coating thereto, the modifying comprising forming each of the grooves to define a nose at which first ends of shear and bearing surfaces meet to define a first angle and a knee at which second ends of the shear and bearing surfaces meet to define a second angle, which is oppositely oriented relative to the first angle; and applying a coating to extend over at least a portion of the textured region and to adhere to the outer surface;

wherein the shear surface of each step is substantially straight along an entirety thereof and parallel with each of the respective shear surfaces of the other steps, the bearing surface of each step is curved along an entirety thereof and parallel with each of the respective bearing surfaces of the other steps and the steps are oriented approximately perpendicular to the direction of radial stress so as to resist deformation of the coating relative to the substrate structure.

* * * * *